US006241127B1

(12) United States Patent
Caldwell

(10) Patent No.: US 6,241,127 B1
(45) **Date of Patent: *Jun. 5, 2001**

(54) SANITARY DRINK BOTTLE DISPENSING SYSTEMS

(76) Inventor: John W. Caldwell, 1 Orchard La. N., Wallingford, PA (US) 19086

( * ) Notice: Subject to any disclaimer, the term of this patent is extended or adjusted under 35 U.S.C. 154(b) by 0 days.

This patent is subject to a terminal disclaimer.

(21) Appl. No.: 09/363,323

(22) Filed: Jul. 28, 1999

Related U.S. Application Data

(62) Division of application No. 08/032,142, filed on Feb. 27, 1998, now Pat. No. 5,971,222.

(51) Int. Cl.[7] ..... B65D 37/00
(52) U.S. Cl. ..... 222/206; 289/288.3; 215/389
(58) Field of Search ..... 222/1, 206, 211, 222/212, 402.12; 239/288, 288.3; 215/389

(56) References Cited

U.S. PATENT DOCUMENTS

| | | | | |
|---|---|---|---|---|
| 1,350,133 | * | 8/1920 | Beatty | 222/206 |
| 1,404,481 | * | 1/1922 | Sadler | 222/206 |
| 5,251,786 | * | 10/1993 | Sarrine | 222/206 |
| 5,971,222 | * | 10/1999 | Caldwell | 222/206 |

* cited by examiner

*Primary Examiner*—Kevin Shaver
*Assistant Examiner*—Thach H Bui
(74) *Attorney, Agent, or Firm*—Woodcok Washburn Kurtz Mackiewicz & Norris LLP

(57) ABSTRACT

Drink bottles are provided having improve sanitation. In accordance with the preferred feature of the invention, a barrier is disposed around the spout of a squeezable drink bottle so as to inhibit contact between the end of the spout from which liquid is expressed and the lips of a person receiving liquid from a bottle. Elimination of reflux and improved sanitation results.

15 Claims, 3 Drawing Sheets

SANITARY DRINK BOTTLE DISPENSING SYSTEMS

This is a divisional of application Ser. No. 08/032,142 filed Feb. 27, 1998, now U.S. Pat. No. 5,971,222.

FIELD OF THE INVENTION

This invention is directed to the field of drink containers of a kind where a comestible fluid is enclosed within a squeezable container having a spout for dispensing of the liquid. Such containers are conventionally called sports bottles or drink bottles and are commonly found at sporting events, athletic contests, and at many other venues.

BACKGROUND OF THE INVENTION

Sports bottles have become commonplace and are used for carrying water or other comestible fluids, such as juices, sports drinks and the like, for use by athletes, spectators, and persons generally at athletic or social events. Such drink bottles come in a wide variety of conformations and sizes. Differing materials can also be used for such sports bottles, however they tend to share one basic characteristic. Sports bottles and other drink bottles are generally made of a resilient material which can be squeezed by a user to force comestible fluid from the interior of the bottle into the mouth of the user. This is conventionally done through a nipple, spigot or spout which frequently has a tap, a cap or valve associated therewith.

In operation, the sports bottle is squeezed and liquid is displaced in one of two general ways. Either fluid is displaced through a tube arrangement reaching to the bottom of the bottle and, thus, is ejected through a protruding spout while the bottle is generally upright, or the bottle is inverted, squeezed, and the liquid expelled through an opening or tube disposed in the top of the bottle. In either configuration, a spout or tube is generally present through which the liquid emerges.

There is a tendency of a user of the bottle to place his or her lips at the site, the tube or spout, where the liquid is dispensed. Such persons may also draw a vacuum on the tube or spout and suck liquid from the container. This gives rise to "refluxing", whereby material which has been in the mouth of a user is introduced into the container. The resulting condition is unsanitary. The tendency of a user to place his or her lips upon prior drink containers in use becomes a particular problem when such containers are shared by a number of individuals. This commonly occurs during team sports when sports bottles are "passed around" among members of the team. The potential for transmission of disease is great and this etiology is often implicated in such spread.

Accordingly, there is a great need for sports bottles and other drink containers which avoid the likelihood that individuals will place their lips upon the location where fluid is ejected so as to avoid cross contamination, the spread of disease, and reflux. It is greatly desired that such improvements not interfere with the basic design of drink bottles, that the same be capable of easy fabrication, that they be aesthetically attractive, and that they be able to be formed from sanitary materials. The present invention is directed to achieving these objectives.

SUMMARY OF THE INVENTION

Figure 2:
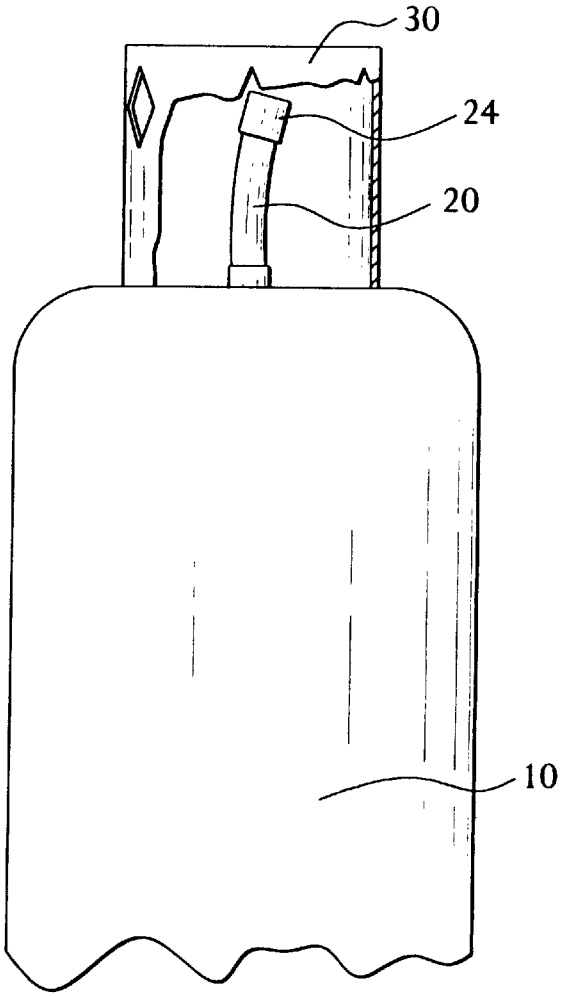
FIGS. 1 and 2 depict drink bottles in accordance with the present invention, having a barrier substantially surrounding the fluid orifice thereof.

The present invention provides sports bottles or other drink bottles for use in a wide variety of contexts including athletics, spectator sports and otherwise. Drink bottles are provided which comprise an enclosed container having flexible walls. The walls are adapted to be squeezed by the human hand so as to displace volume from their interior. Accordingly, such bottles may be of any convenient size or shape for this purpose. The enclosed containers which form the bottles have a wall or walls, and, frequently, end portions. It is conventional that such containers be generally cylindrical, however triangular eliposoidal and other cross sections may be employed. The containers could be spherical, ellipo-spherical, concave, convex, and generally in any shape which is adapted for holding in the hand and being squeezed. Since it is conventional that such bottles be generally cylindrical, such shapes shall be presumed hereinafter, although it is to be understood that other shapes may be employed in accordance with the present invention and still remain within its scope.

Accordingly, a drink bottle having walls and a pair of ends is provided in such a fashion as to be enclosed. A spout is also provided, conventionally in one of the ends of the container. The walls of the container are sufficiently flexible such that when they are squeezed, a volume is displace within the container. In this way, a liquid, preferably water or a comestible liquid, within the container is expressed upon squeezing. The spout may be either affixed to, inserted through, or otherwise put into contact with one of the end walls or otherwise. In accordance with one embodiment, the spout has a potion which is exterior to the drink bottle and also a portion which is interior to the bottle reaching to the vicinity of the bottom of the bottle. In this way, upon squeezing of the walls of the bottle, liquid is forced up through the spout and caused to emerge at an end of the spout remote from the container portion of the drink bottle. Such end may be seen to comprise an orifice through which the water or comestible liquid is expelled or dispensed. In accordance with another embodiment, the spout is attached to an end of the drink bottle such that the bottle must be inverted to express or dispense liquid from its interior through squeezing of the walls of the bottle, through gravity or otherwise.

In any event, the spout will have a end which is remote from the container portion of the drink bottle, said end comprising an orifice. In accordance with the invention, the spout end and its orifice are surrounded by a barrier adjacent thereto which is disposed so as to inhibit the contact between the spout end and the lips of the person receiving liquid to be dispensed through the orifice. The nature of the barrier is such as to render it awkward, inconvenient, or difficult to effect placement of a person's lips upon the spout end; it is not necessary that such placement be rendered completely impossible. As will be appreciated, there are a number of ways to effect placement of the barrier adjacent to a spout end of a drink bottle so as to inhibit unsanitary practices. In general, the overall configuration of the drink bottle must be considered in effecting design of an appropriate barrier for that bottle. For example, when the spout is physically attached to one end of a drink bottle such that it is necessary to tilt the bottle into an inverted position in order to effect dispensing of liquid from the interior of the bottle, then an integral barrier may be formed on the end to surround the spout and inhibit labial contact. If the nature of the drink bottle is such that the spout is relatively long such that the orifice is disposed a relatively great difference from the end of the drink bottle, then it may be desirable to configure a barrier around the spout end and its orifice which is not in physical contact with an end of the drink bottle.

It will be appreciated that the spout to be protected from labial contact may comprise a valve. Such valves may be in a number of configurations including sliding valves, rotating valves, compression valves, and other forms. Moreover, it will be appreciated that the spout, itself may have a number of forms and cross sections including circular cross section, rectilinear cross section, triangular and other angular cross sections and, in short, any shape which a persons skilled in the art may select to perform its function.

The barriers used in connection with the present invention are preferable perforated in order to provide a pleasing, decorative appearance. It is within the spirit of the invention to provide barriers which are not perforated, however, and in some cases, such barriers will be preferred. As stated above, the barriers either may be integrally formed or molded with an end of the drink bottle or may be designed so as to fit over the dispensing spout at a location remote from an end of the drink bottle. Remote barriers are conventionally made in spherical form having a portion which fits over the dispensing tube of spout and, preferably, in cooperation therewith so as to place the barrier in a location proximate the end of the spout. Cylindrical, oblique and any other forms of remote barrier my also be constructed. Likewise, such barriers may be perforate or not depending upon design criteria. For remote barriers, it is preferred that the barrier engage the dispensing spout or tube with a friction fit or adhesively so as to locate the barrier in its proper position surrounding the dispensing end of the spout. Such remote barriers can generally be removed so as to effect washing and the like, thus facilitating sanitation.

The present invention also provides methods for dispensing liquids from squeezable drink bottles, having spouts for the dispensing of the liquid. Such methods comprise squeezing the bottle to cause liquid contained therewithin to travel along the spout and to emerge from an opening or orifice on the spout at a location substantially enclosed by a barrier disposed about said opening. The barrier is disposed so as to inhibit contact between the spout and the lips of the person receiving the liquid.

Persons with skill in the art will appreciate that a wide variety of materials, especially plastic materials, may be used in connection with the present invention. It is preferred that drink bottles be prepared from polyethylene, polyproylene, and any of a wide variety of other squeezable, plastic materials which are commonly used for such purpose. More exotic materials such as Nalgene® may be employed as well. The key requirement is that the drink bottle be capable of repeated use, that the materials forming it be relatively inexpensive, but at the same time be capable of easy manufacture, and that the same be amenable to design criteria as may be required by the routineers in the art.

It should be appreciated that the particular material from which the drink bottles of the present invention are made are not critical so long as the material selected are consistent with the objects and purposes set forth herein. Likewise, the barriers of the present invention may be formulated from any plastic material which can cooperate with the drink bottle, spout and other appurtenances of the drink bottles of the present invention in a fashion which gives rise to the objects and benefits set forth herein.

Figure 1:
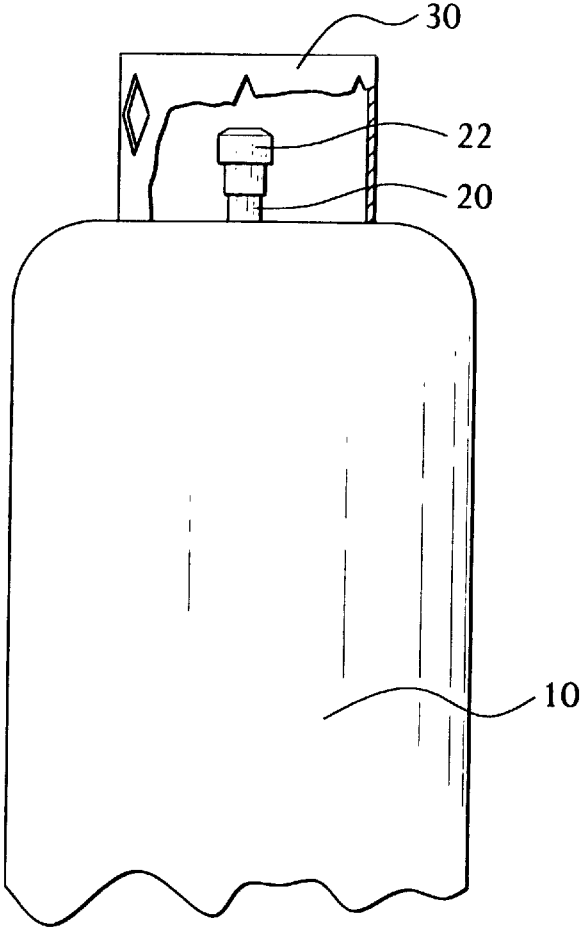
Figure 3:
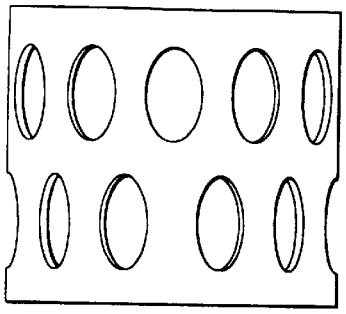
FIGS. 3, 4, 5 and 6 depict various designs for barriers useful in connection with the present invention.
Figure 4:
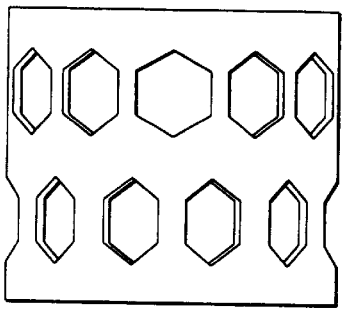
Figure 5:
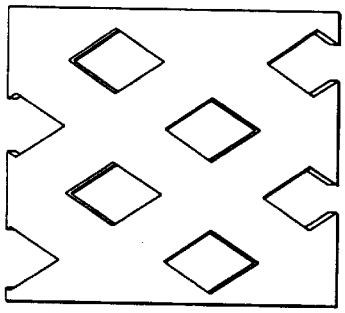
Figure 6:
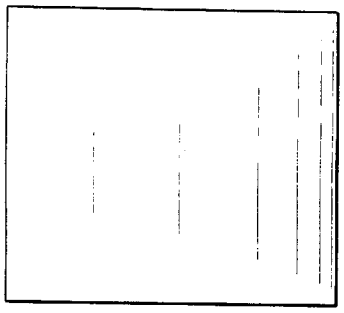

FIGS. 1 and 2 depict a schematic drink bottle in accordance with the invention. The enclosed container, 10 is sized so as to be squeezable by the human hand. A spout 20, which may optionally have valve 22 or a cap 24 is provided in fluid communication with the interior of the drink bottle. The spout may either communicate with the bottom of the drink bottle or not depending upon design criteria. A barrier, 30 is disposed around the end of the spout remote from the container and is sized to permit the easy manipulation of the valve, for removal and replacement of the cap 24, or otherwise to operate the drink bottle, but to make it difficult or impossible for a person's lips to come in contact with the end of the spout in normal use. FIGS. 3 through 6 depict various designs of barriers which may be used in conjunction with the present invention. The various perforate designs are aestically attractive but all function equally well in terms of discouraging labial contact with the end of the drink dispensing spout. A solid barrier is easy to mold, and is particularly preferred for some applications. It is preferred that the barriers of this type be integrally molded with the enclosed container.

Figure 7:
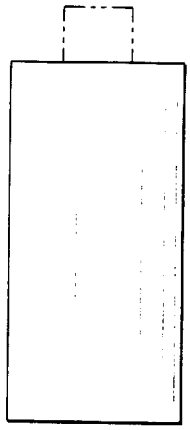
FIGS. 7, 8, and 9 show various arrangements of sports bottles all of which may be employed in connection with the present invention. This illustrates the wide applicability of the invention.
Figure 8:
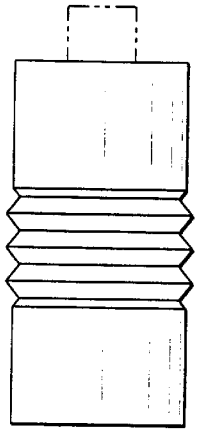
Figure 9:
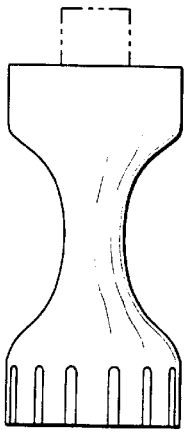

FIGS. 7, 8, and 9 illustrate the fact that a wide variety of drink bottles may be fitted with barriers in accordance with the present invention. Which barriers are shown in phantom. In short, the precise geometry of the drink bottles, the spout, and the like is not critical so long as an effective barrier is diposed about the distal end of the spout so as to inhibit contact with the lips of a person employing the drink bottle.

Figure 10:
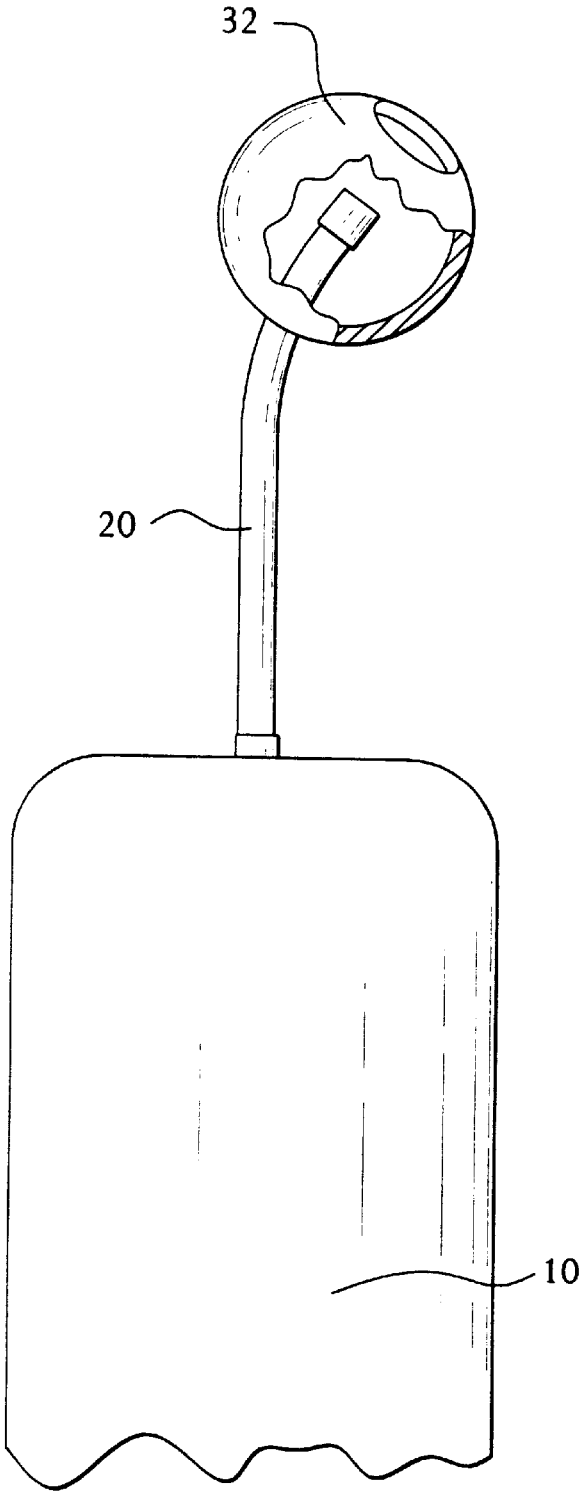
FIG. 10 depicts another embodiment of the invention wherein a barrier is affixed to the end of a spout on a sports bottle. The barrier is not attached to the main body of the bottle.
Figure 11:
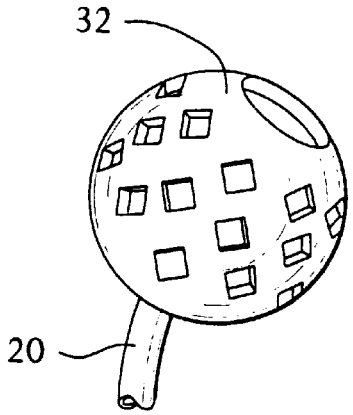
FIG. 11 depicts a perforated design for the remote barrier of FIG. 10.

FIG. 10 shows the employment of a remote barrier with another form of drink bottle in accordance with the present invention. In this embodiment, the tube 20 which may, in accordance with preferred embodiments, reach to the bottom of the container 10 is relatively long. In this case the barrier is fitted around the spout itself so as to inhibit labial contact with the user. FIG. 11 shows another design of such remote barrier employing perforations for aesthetic purposes. Such remote barriers may be formed in nearly any shape including cylindrical, oblate, and other shapes that may be selected by routine design criteria.

While a number of embodiments have been set forth with specificity in the present specification, they should not be taken as being limiting in any way of the invention which is measured solely by the appended claims.

What is claimed is:

1. A drink bottle comprising an enclosed container having flexible walls adapted for squeezing by the human hand together with a spout for the dispensing of a liquid from the interior of the container upon the application of squeezing force upon the walls thereof;

said bottle further comprising a barrier adjacent to the end of said spout remote from the container, said barrier having at least one orifice which permits the dispensing of said liquid, said barrier being disposed about said spout end so as to inhibit contact between the spout end and the lips of a person receiving the dispensed liquid.

2. The drink bottle of claim 1 wherein said spout further comprises a valve.

3. The drink bottle of claim 1 wherein said spout has a portion in said interior of said container adapted for the dispensing of said liquid from the bottom of the drink bottle.

4. The drink bottle of claim 1 wherein said barrier is integral with the container.

5. The drink bottle of claim 1 wherein said barrier and said container are co-molded from polymer.

6. The drink bottle of claim 1 wherein said barrier is perforated.

7. The drink bottle of claim 1 wherein said barrier is not in contact with said container.

8. The drink bottle of claim 1 wherein said barrier substantially surrounds said spout at a location remote from the point of contact between said spout and the container.

9. The drink bottle of claim 8 wherein said barrier is attached to said spout.

10. A method for dispensing a liquid from a squeezable drink bottle having a spout, comprising squeezing said bottle to cause said liquid to travel along the spout and to emerge from an opening on the spout at a location substantially enclosed by a barrier disposed about said opening of said spout, said barrier being disposed so as to inhibit contact between said spout and the lips of a person receiving said liquid.

11. A squeezable drink bottle comprising an enclosed container having flexible walls together with a spout for the dispensing of a comestible liquid from the interior of the container upon the application of squeezing force upon the walls thereof;

said bottle further comprising a barrier substantially surrounding the end of said spout from which the liquid is dispensed, the barrier having at least one opening therein which permits the dispensing of said liquid;

the geometry of said bottle, spout and barrier being such that an effective amount of said barrier is disposed about the dispensing end of the spout so as to inhibit contact with the lips of a person employing the drink bottle.

12. The drink bottle of claim 11 wherein said spout further comprises a valve.

13. The drink bottle of claim 11 wherein said spout has a portion inside of said container adapted for the dispensing of said liquid from the bottom of the drink bottle.

14. The drink bottle of claim 11 wherein said barrier and said container are co-molded from polymer.

15. The drink bottle of claim 11 wherein said barrier is perforated.

* * * * *